United States Patent [19]

Kubus et al.

[11] 4,048,757

[45] Sept. 20, 1977

[54] SYSTEM FOR METERING ABRASIVE MATERIALS

[75] Inventors: James Michael Kubus, Buffalo, N.Y.; Ray Bruce Seese, Conroe; Bela Lee Watson, San Leon, both of Tex.

[73] Assignee: Union Carbide Corporation, New York, N.Y.

[21] Appl. No.: 714,670

[22] Filed: Aug. 16, 1976

[51] Int. Cl.[2] ..... B24C 3/32

[52] U.S. Cl. ..... 51/436; 51/411 R X; 15/3.5; 137/268; 239/317

[58] Field of Search ..... 15/3.5; 51/8 H, 11, 51/12, 8 R; 137/205.5, 268; 239/310, 317, 365, 366, 368, 369

[56] References Cited

U.S. PATENT DOCUMENTS

| | | | |
|---|---|---|---|
| 1,185,888 | 6/1916 | Durham | 51/8 R |
| 2,087,694 | 7/1937 | Malmros | 15/3.5 X |
| 2,388,818 | 11/1945 | Bick | 51/12 X |
| 2,389,616 | 11/1945 | Franklin | 51/12 |
| 3,485,074 | 12/1969 | Compton | 51/12 X |
| 3,807,434 | 4/1974 | Rasmussen | 137/205.5 X |

*Primary Examiner*—Gary L. Smith
*Attorney, Agent, or Firm*—Dominic J. Terminello

[57] ABSTRACT

A system of pressure gauges and pipeline arrangement is described for metering abrasive materials into a gas stream for subsequent injection into a pipeline to be cleaned.

3 Claims, 3 Drawing Figures

SYSTEM FOR METERING ABRASIVE MATERIALS

This invention relates to a system for metering abrasive materials into a gas stream wherein the abrasive laden gas is then introduced into a pipeline to be cleaned by such abrasive laden gas stream. More particularly this invention relates to such a system for use in cleaning pipelines fo any diameter.

A method has been developed for cleaning pipelines using an abrasive material or sand; the operation being applicable to large diameter long distance gas transmission lines as well as to process lines used in plants and refineries. Sand or other abrasive material which is stored in a container is forced under air or gas pressure into one end of a pipeline and propelled under pressure through the line and out an open end of the line.

In such pipeline cleaning process, it has always been a problem to provide the right quantity of said into the gas stream and to provide a smooth injection of such stream into the pipeline to be cleaned.

There are many systems known in the prior art for conveying solid particles through pipe. Three types of systems are frequently used by industry. They are:

1. Systems in which the material enters an air stream induced by vacuum or under positive pressure.
2. Systems in which air and material are intermixed simultaneously at the entrance to the conveying line by gravity or mechanical feeders.
3. Systems in which air enters a stored mass of material to cause flow. These may be called air-into-material, blow tank, or fluidized bed systems.

However, up until now the problem when employing any of the above systems has been the metering of the abrasive into the gas conveyer stream and the conveying of such material without any settling out of materials on the bottom of the conveying lines.

It was discovered that in order to achieve the desired abrasive rate into the gas stream and to carry such material in such gas stream, a critical arrangement of piping, hoses and valves was necessary.

Accordingly, it is an object of this invention to provide an abrasive material metering system which will provide reliable and essentially reproducible metering of abrasive material into a gas stream.

Another object is to provide such a system especially suited for use with a 1,000 pound capacity abrasive vessel.

Figure 1:
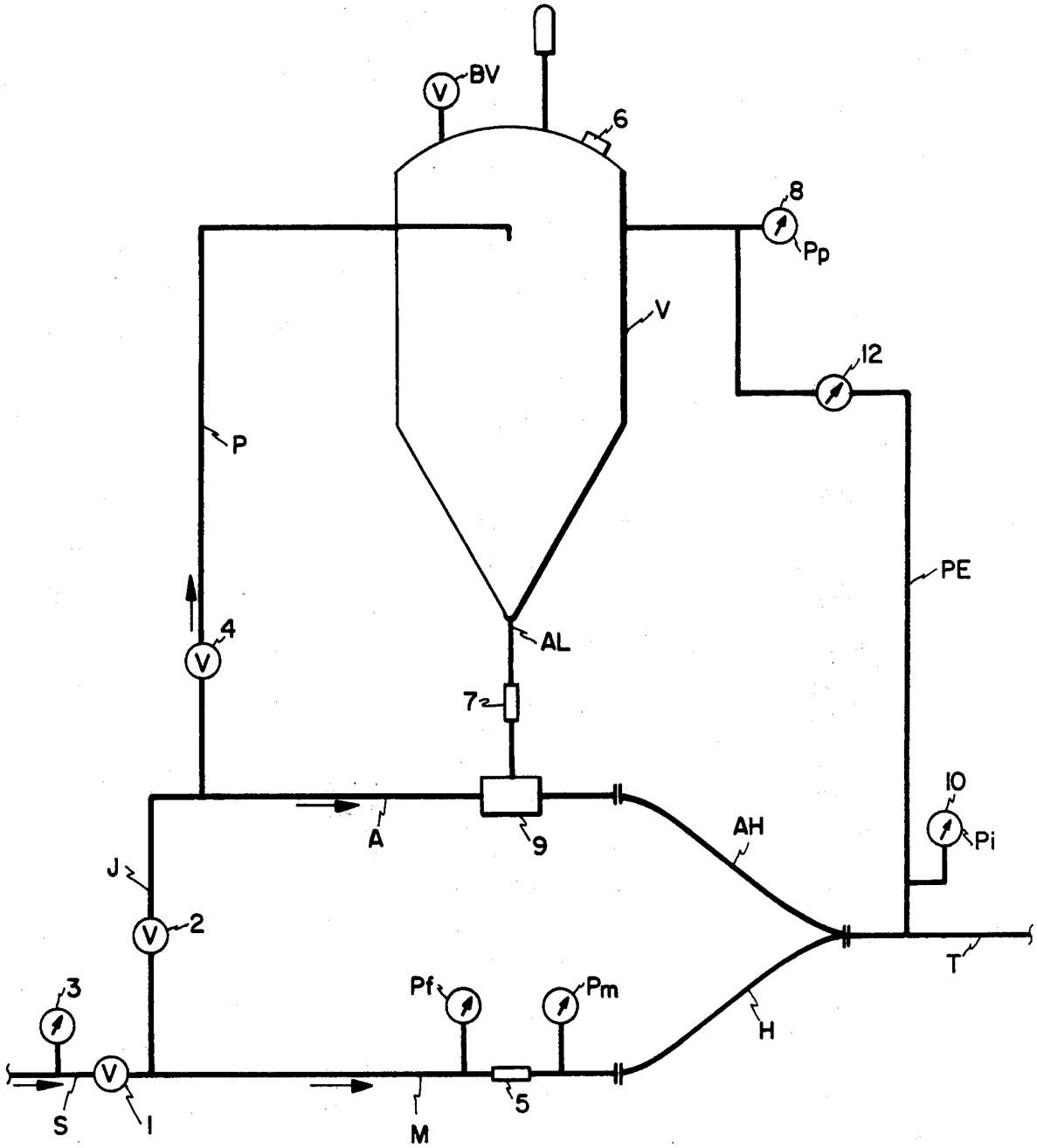
Figure 2:
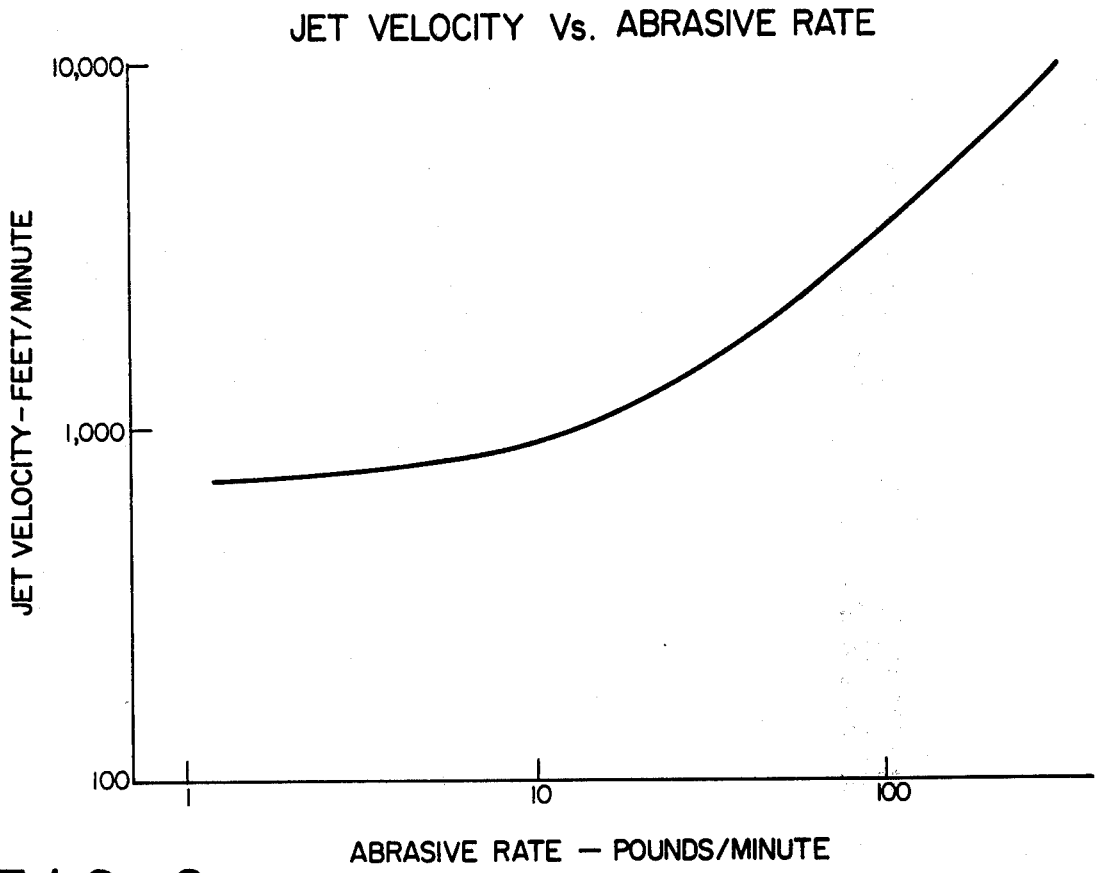
Figure 3:
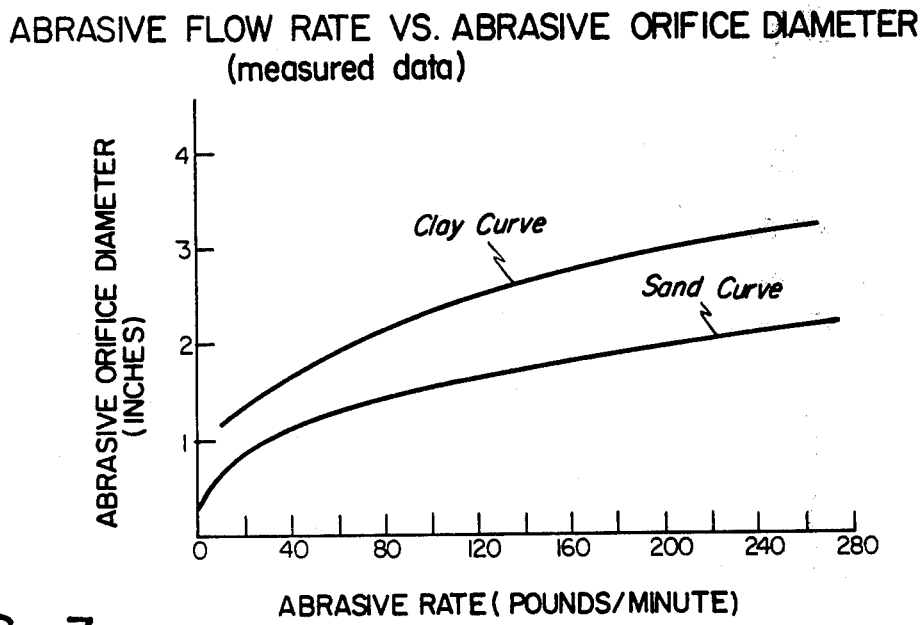

These and other objects will either be pointed out or become apparent from the drawings wherein;

FIG. 1 is a schematic representation of a metering system embodying the concept of the invention; and FIGS. 2 and 3 are curves of data illustrating respectively the jet velocity necessary to carry abrasive introduced at a certain abrasive rate and metering orifice size necessary for a specific abrasive flow rate.

Referring to the drawing, the system includes an unfired pressure vessel V which is preferably a conical-bottomed hopper. The advantage of a conical bottomed hopper is that by making the cone angle of the vessel sufficiently greater than the angle of repose of the solids, bridging of the solid material across the bottom of the vessel can be eliminated. In this preferred embodiment the vessel conical angle is 60 degrees. The vessel V has a loading port 6 and a blowdown valve BV.

A gas supply line s is connected to source of gas, usually nitogen. Line S contains a gas supply valve 1 and pressure gage 3. The gas supply line S branches downstream of valve 1 into a main gas line M and a jet gas line J. Jet gas line J contains a valve 2 for controlling flow in such line. The main gas line M contains a critical flow gas orifice meter 5 which has a pressure gage $P_f$ upstream therefrom and a pressure gage Pm downstream therefrom. The main gas line M contains a gas hose H leading to the pipeline T to be cleaned. Jet gas line J branches downstream of valve 2 into a pot gas line P and an abrasive gas line A. Abrasive gas line A contains a mixing chamber 9 and an abrasive hose AH leading to the pipeline T where it joins with the main gas line M. The pot gas line P contains a pot valve 4. The line P terminates in and opens into the top of the abrasive vessel V. The bottom of the conical hopper V is connected to an abrasive line A1 containing an abrasive metering orifice 7. The abrasive metering orifice is connected to the mixing chamber 9. Pressure indicating line PE is connected from the top of vessel V and to the inlet of the pipeline T. A pot pressure gage 8 is located in line PE just outside the vessel V and a pipeline inlet pressure gage 10 is located in line PE just before the inlet to the pipeline. Gage 12 is provided in line PE to read the dynamic difference in the pressure in the pot ($P_p$) and the pipeline inlet pressure ($P_1$).

Briefly the system operates as follows: With the jet 2 and pot 4 pressurization valves closed, the gas propellant is started through the supply valve 1 to establish a predetermined upstream orifice tap pressure ($P_f$) and a propellant flow rate. Then a portion of this main propellant stream is diverted to the abrasive gas line a through the jet valve 2 in jet line J to provide sufficient gas velocity in the abrasive hoses to carry a load of sand or clay. The proper gas velocity, hereafter referred to as the "jet velocity," is selected from data shown in FIG. 2.

The correct quantity of abrasive is obtained by metering the flow of abrasive using an orifice plate 7 mounted in abrasive line AL at the bottom of the vessel V. The size of abrasive orifice depends on the particular abrasive rate required for cleaning a given sized pipeline. It is selected from data shown in FIG. 3. The pot pressure valve 4 is pot gas line P is necessary to equalize the dynamic pot pressure ($P_1$) and the dynamic pipeline inlet pressure ($P_1$). When this is accomplished, the correct amount of abrasive will begin to flow into the pipeline.

Having described the invention in terms of its general operation the following example is given of a specific technique for operating the system of the invention.

DEFINITIONS

The following notation is used in reference to a 1,000-pound capacity system shown schematically in FIG. 1.

Q, *Propellant Rate* CFM at NTP — flow rate of gas to be injected into the pipeline.

*d, Propellant Orifice Diameter* — Diameter of propellant critical flow orifice to be used for a job.

AR, *Abrasive Rate* (lbs./Min.) — mass flow rate of abrasive to be injected into the pipeline.

$P_{f1}$, *Initial Flow Reading* psi — Pressure reading from the upstream tap $P_f$ of the propellant critical flow orifice corresponding to a flow equal to the propellant rate, Q.

$V_j$, *Jet Velocity,* ft/min. — Minimum propellant gas velocity to guarantee saltation of abrasive entering the gas stream at abrasive rate, AR.

$q_j$, *Jet Flow Rate,* cfm at NTP — flow rate of gas propellant necessary to guarantee saltation velocity, $v_j$, in the mixing chamber. (Saltation Velocity is that velocity required to transport an amount of material horizontally without the formation of material sludges or settling out af any material on the bottom of the conveying line.

$P_{f2}$, *Operating Flow Reading,* psi — Pressure reading from the upstream tap, $P_f$ of the propellant critical flow orifice, 5, corresponding to a mass flow of $(Q - q_j)$.

$d_s$, *Diameter of Abrasive Orifice for Sand,* "inches" — Diameter of abrasive orifice to give abrasive rate, AR, in sand service.

$d_c$, *Diameter of Abrasive Orifice for Clay,* "inches" — Diameter of abrasive orifice to give abrasive rate, AR, in clay service.

ENGINEERING CALCULATIONS

The following engineering calculations are required to determine the operating points for each cleaning job.

1. Determine:
   a. Propellant rate, Q, cfm at NTP
   b. Abrasive rate, AR, lbs/min.
   c. Initial flow reading, $P_{f1}$, psi
   d. Propellant orifice diameter, *d*, in.
2. Using FIG. 2, detemine orifice diameters $d_s$ and $d_c$.
3. Using FIG. 3, determine the minimum jet velocity, $v_j$.
4. Determine the saltation rate, $q_j$, where $$q_j = [V_j(P_f + 14.7)A_j]/14.7$$

$A_j$ = cross-sectional area of the abrasive hose, sq. ft.

5. Determine $P_{f2}$, the reading on pressure gauge $P_f$ to corresponding to a flow of $(Q - q_j)$ through the *d* diameter orifice plate.

OPERATING PROCEDURE

All valves are assumed closed.

1. Install the *d*-inch diameter critical flow propellant orifice 5.
2. Install the $d_s$ or $d_c$ inch diameter abrasive orifice plate 7 for the appropriate abrasive medium.
3. Load the abrasive medium through the loading port 6.
4. Regulate the gas propellant flow with supply valve 1 until pressure gauge $P_f$ reads $P_{f1}$. This will establish propellant flow rate Q which is to be injected into the pipeline.
5. Divert jet flow rate $q_j$ to the mixing chamber 9 by regulating jet valve 2 until pressure gauge $P_f$ reads $P_{f2}$. This will establish a propellant flow through the mixing chamber 9 and abrasive hoses A H to provide the abrasive jet velocity.
6. Equalize vessel pressure by regulating pot pressure valve 4 unitl differential pressure gauge 12 reads zero. This will allow abrasive to enter the conveying stream.

The metering system and method of operation just described is the only arrangement of piping which produces efficient control of abrasive metering.

For example, if the pot pressure is not controlled by valve 4, that is, if the valve is fully opened the abrasive rate will be too great. Also, other arrangement of the gas lines in the systems result in pressure differentials between pot pressure $P_p$ and pipeline pressure $P_1$ which would either not permit abrasive material flow or provide undesired flow. By using the arrangement shown in FIG. 1 and throttling valve 4, a pot pressure equal to or greater than pressure at $P_1$ was obtained and the proper abrasive rate achieved.

What is claimed is:

1. A system for metering abrasive material into a flowing gas stream which abrasive laden gas stream is to be used to clean the interior of a pipeline, comprising a gas supply line communicating with a source of gas and branching into the main gas line communicating with the pipeline to be cleaned and jet gas line; said jet gas line containing a flow control valve and branching downstream of said flow control valve into a pot gas line and an abrasive gas line; said pot gas line communicating with the top of an abrasive vessel and having a valve for controlling the pressure in the top of said abrasive vessel, a mixing chamber located in said abrasive gas line and communicating with the bottom of said abrasive vessel, a metering orifice between said mixing chamber and the bottom of said vessel to assist in the metering of abrasive flow from said vessel; a gas flow orifice located in the main gas line between the source of gas and the pipeline to be cleaned; a pressure indicating line connected from the top of said vessel to a point adjacent the inlet in of said pipeline and containing a pot pressure gage adjacent the top of said vessel and a pipeline pressure gage adjacent the inlet to said pipeline and pressure differential gage therebetween for reading the difference in the dynamic pressure at the pot pressure gage and the inlet pressure gage.

2. System according to claim 1 wherein the vessel has a conically shaped bottom.

3. Method for metering abrasive materials in a pipeline cleaning process wherein an abrasive laden gas stream is used to clean the interior of said pipeline. comprising providing a main gas stream from a source of gas to a pipeline to be cleaned;

regulating the flow of said main gas stream to provide the desired flow rate to be injected with said pipeline;

diverting some gas flow from the main gas stream to a mixing chamber and to the top of a vessel containing abrasive materials to be entrained in a gas stream;

metering said abrasive materials from the bottom of said vessel into said mixing chamber;

entraining said metered abrasive material in said gas flow through said mixing chamber;

controlling the pressure in the top of said vessel until the difference in the pressure in the vessel and the pressures at the pipeline to be cleaned is zero and then combining the abrasive entrained gas flow with the main gas stream and injecting said combined streams into the pipeline to be cleaned.

* * * * *